US010272402B2

(12) United States Patent
Tun et al.

(10) Patent No.: US 10,272,402 B2
(45) Date of Patent: Apr. 30, 2019

(54) STIRRING CONTAINER AND STIRRING APPARATUS

(71) Applicant: JIYONSON CO., LTD., New Taipei (TW)

(72) Inventors: Yun-Long Tun, New Taipei (TW); Shih-Ming Hsu, New Taipei (TW)

(73) Assignee: Jiyonson Co., LTD., New Taipei (TW)

( * ) Notice: Subject to any disclaimer, the term of this patent is extended or adjusted under 35 U.S.C. 154(b) by 1135 days.

(21) Appl. No.: 14/447,992

(22) Filed: Jul. 31, 2014

(65) Prior Publication Data

US 2015/0036452 A1 Feb. 5, 2015

(30) Foreign Application Priority Data

Aug. 2, 2013 (TW) ..... 102127710 A

(51) Int. Cl.
*B01F 9/06* (2006.01)
*B01F 3/18* (2006.01)
(Continued)

(52) U.S. Cl.
CPC ..... *B01F 9/06* (2013.01); *B01F 3/18* (2013.01); *B01F 9/0041* (2013.01); *B01F 9/02* (2013.01);
(Continued)

(58) Field of Classification Search
CPC .... B01F 2009/0092; B01F 9/06; B01F 9/001; B01F 9/0007; B01F 2009/0059;
(Continued)

(56) References Cited

U.S. PATENT DOCUMENTS 338,673 A * 3/1886 Mowrer ..... F28F 13/12 165/109.1
3,147,956 A 9/1964 Phillips
(Continued)

FOREIGN PATENT DOCUMENTS

CN 101253897 B 9/2008
CN 102160584 B 8/2011
(Continued)

OTHER PUBLICATIONS

Office Action to the corresponding Taiwan Patent Application rendered by Taiwan Intellectual Property Office (TIPO) dated Jun. 9, 2015, 7 pages.
(Continued)

*Primary Examiner* — Tony G Soohoo
*Assistant Examiner* — Elizabeth Insler
(74) *Attorney, Agent, or Firm* — Skaar Ulbrich Macari, P.A.

(57) ABSTRACT

A stirring container and a stirring apparatus are provided. The stirring container includes a barrel and a plurality of stirring paddles. The barrel is defined with an inner surface, an outer surface, and a center axis. The first opening and a second opening are located at two ends of the center axis; and the paddles are fixed on the inner surface of the barrel and extend from the first opening to the second opening and the extending directions thereof are skewed to the center axis. The stirring apparatus includes the aforesaid stirring container, a supporting structure and a rotation module. The supporting structure connects to the outer surface of the barrel to make the barrel rotatable and covers the second opening. The rotation module connects to the outer surface to rotate the stirring container. Thereby, the stirring container and the stirring apparatus can provide better stirring results.

16 Claims, 9 Drawing Sheets

(51) Int. Cl.
*B01F 9/02* (2006.01)
*B01F 15/06* (2006.01)
*B01F 9/00* (2006.01)

(52) U.S. Cl.
CPC ..... *B01F 15/06* (2013.01); *B01F 15/066* (2013.01); *B01F 2009/0092* (2013.01); *B01F 2015/062* (2013.01)

(58) Field of Classification Search
CPC ..... B01F 2009/0094; F27B 7/14; F27B 7/16; F27B 7/161; F27B 7/162
USPC ..... 366/225, 227, 228
See application file for complete search history.

(56) References Cited

U.S. PATENT DOCUMENTS 4,062,776 A 12/1977 Blok
4,289,279 A * 9/1981 Brandt ..... B02C 17/225 241/102
4,571,089 A 2/1986 Gudlauski et al.
5,443,637 A * 8/1995 Long, Jr. ..... A01C 1/06 118/16
7,802,914 B2 9/2010 Khouri
8,220,444 B2 * 7/2012 Cheung ..... F02M 29/06 123/306
2008/0213742 A1 * 9/2008 Asgari ..... B01F 9/0016 435/1.1
2008/0217444 A1 * 9/2008 Michalek ..... A61L 11/00 241/1
2011/0243808 A1 * 10/2011 Fossey ..... B01F 9/06 422/295

FOREIGN PATENT DOCUMENTS

GB 2238814 A 6/1991
TW 201121642 A1 7/2011
WO 2007078876 A1 7/2007

OTHER PUBLICATIONS

Search Report to the corresponding European Patent Application rendered by European Patent Office (EPO) dated Apr. 12, 2014, 7 pages.

* cited by examiner

STIRRING CONTAINER AND STIRRING APPARATUS

PRIORITY

This application claims priority to Taiwan Patent Application No. 102127710, filed on Aug. 2, 2013, which is hereby incorporated herein by reference in its entirety.

FIELD

The present invention provides a container and an apparatus comprising the container; more particularly, it provides a stirring container for stirring a material and a stirring apparatus comprising the stirring container.

BACKGROUND

Conventional stirring containers and stirring apparatuses are used for stirring solid, liquid or gaseous materials. Particles of liquid and gaseous materials have higher degrees of freedom, so they can get mixed with each other autonomously even without an external force and, moreover, adequate mixing can be achieved through convection even when stirring is carried out in a single direction. Therefore, it is easy to design stirring containers and stirring apparatuses that are used for stirring liquid or gaseous materials.

Compared to the stirring of liquid or gaseous materials, stirring a solid material is difficult because the solid material needs to move and be adequately mixed. Because solid material particles cannot move without being driven by an external force, usually only particles near the stirring paddles can be stirred by the stirring paddles during the stirring process. Therefore, solid material must be stirred for a relatively long time to accomplish adequate mixing. If stirring time needs to be shortened, the speed of the stirring paddles needs to be increased. With increased speed the pushing force applied to the particles by the stirring paddles and the pressure from other particles must be taken into consideration to avoid damage to the particles. For this reason, there is still a limitation on the stirring speed.

To shorten the stirring time, most conventional stirring containers or stirring apparatuses are designed to have a large accommodating space and large stirring paddles so that more particles can be stirred at the same time. However, the large accommodating space means that there is a large gap between the container and the stirring paddles, which makes it difficult to adequately stir the solid material because more particles dwell in the gap without being stirred. On the other hand, the large stirring paddles might cause the particles to move only in a single direction or even cause all the particles to be driven by the stirring paddles simultaneously, which would make the stirring ineffective instead.

Accordingly, a need exists in the art to provide a better solution for improved stirring.

SUMMARY

An objective of the present invention includes providing a stirring container which accommodates and stirs solid material and is capable of adequately stirring or moving the solid material.

To achieve the aforesaid objective, certain embodiments of the stirring container include a barrel and a plurality of stirring paddles. The barrel is defined with an inner surface, an outer surface, a center axis, a first opening and a second opening. The first opening and the second opening are located at two ends of the center axis respectively. The stirring paddles are fixed on the inner surface of the barrel, and each of the stirring paddles extends from the first opening to the second opening and has an extending direction skewed towards the center axis.

Another objective of the present invention includes providing a stirring apparatus which is capable of adequately stirring and moving the solid material.

To achieve the aforesaid objective, certain embodiments of the stirring apparatus includes the aforesaid stirring container, a supporting structure and a rotation module. The supporting structure connects to the outer surface of the barrel to make the stirring container rotatable and covers the second opening. The rotation module is joined to the outer surface of the barrel to rotate the stirring container.

The detailed technology and preferred embodiments implemented for the subject invention are described in the following paragraphs accompanying the appended drawings for people skilled in this field to well appreciate the features of the claimed invention.

DETAILED DESCRIPTION

In the following description, the present invention will be explained with reference to example embodiments thereof. It shall be appreciated that, these example embodiments are not intended to limit the present invention to any specific example, embodiment, environment, applications or implementations described in these example embodiments. Therefore, description of these example embodiments is only for purpose of illustration rather than to limit the present invention.

Figure 1:
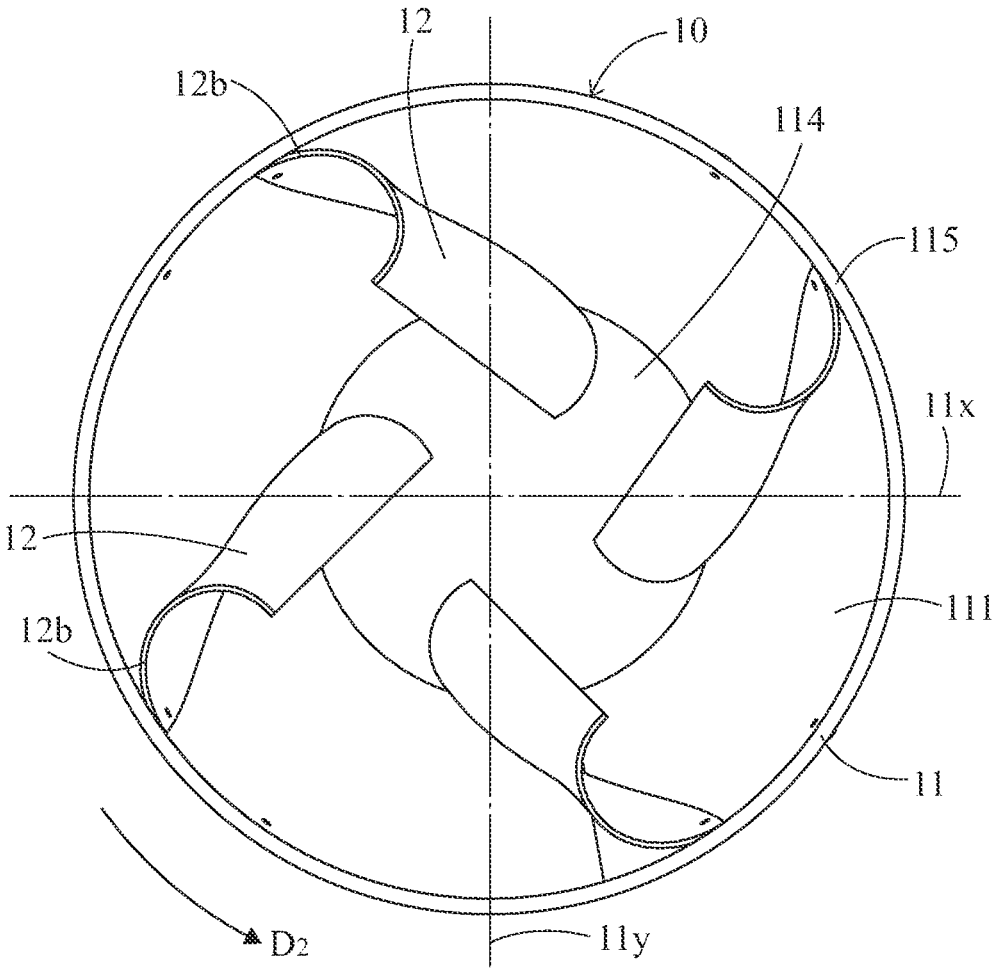
FIG. 1 is a rear view of a stirring container according to the first embodiment of the present invention.
Figure 2:
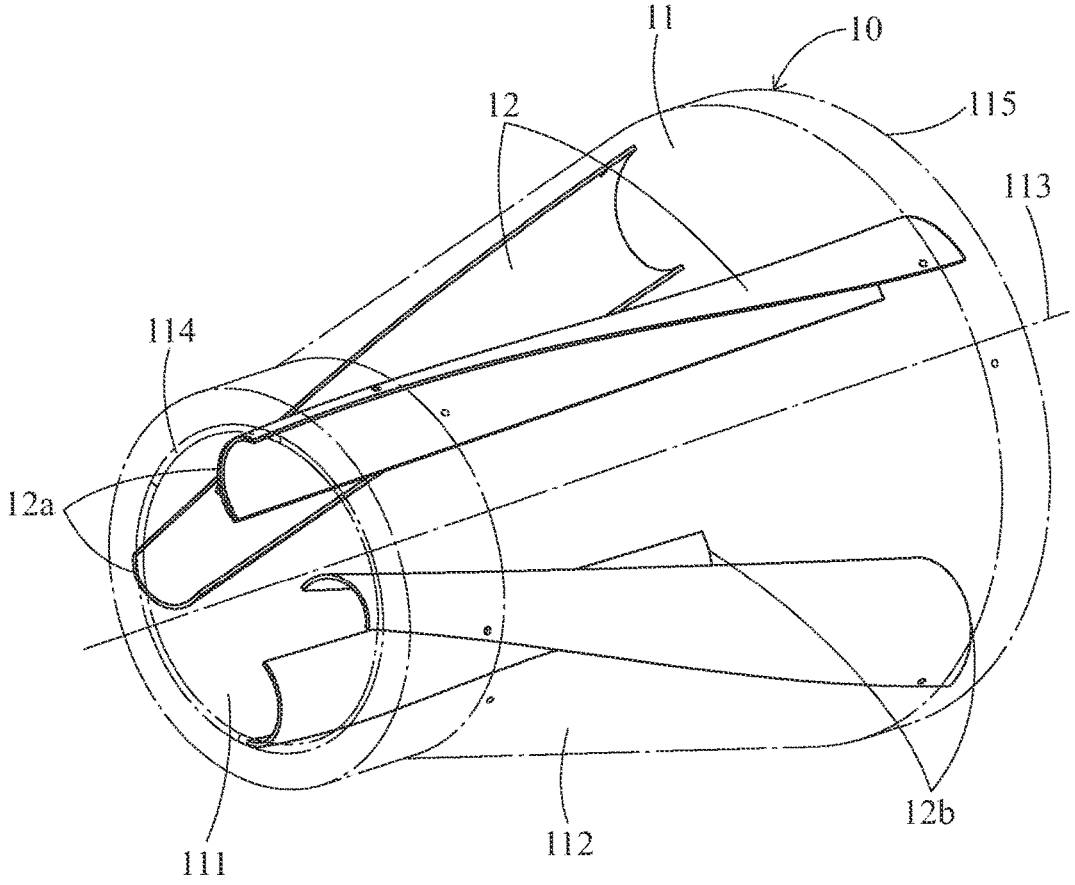
FIG. 2 is a perspective view of the stirring container according to the first embodiment of the present invention (where the barrel is drawn in imaginary lines)
Figure 3A:
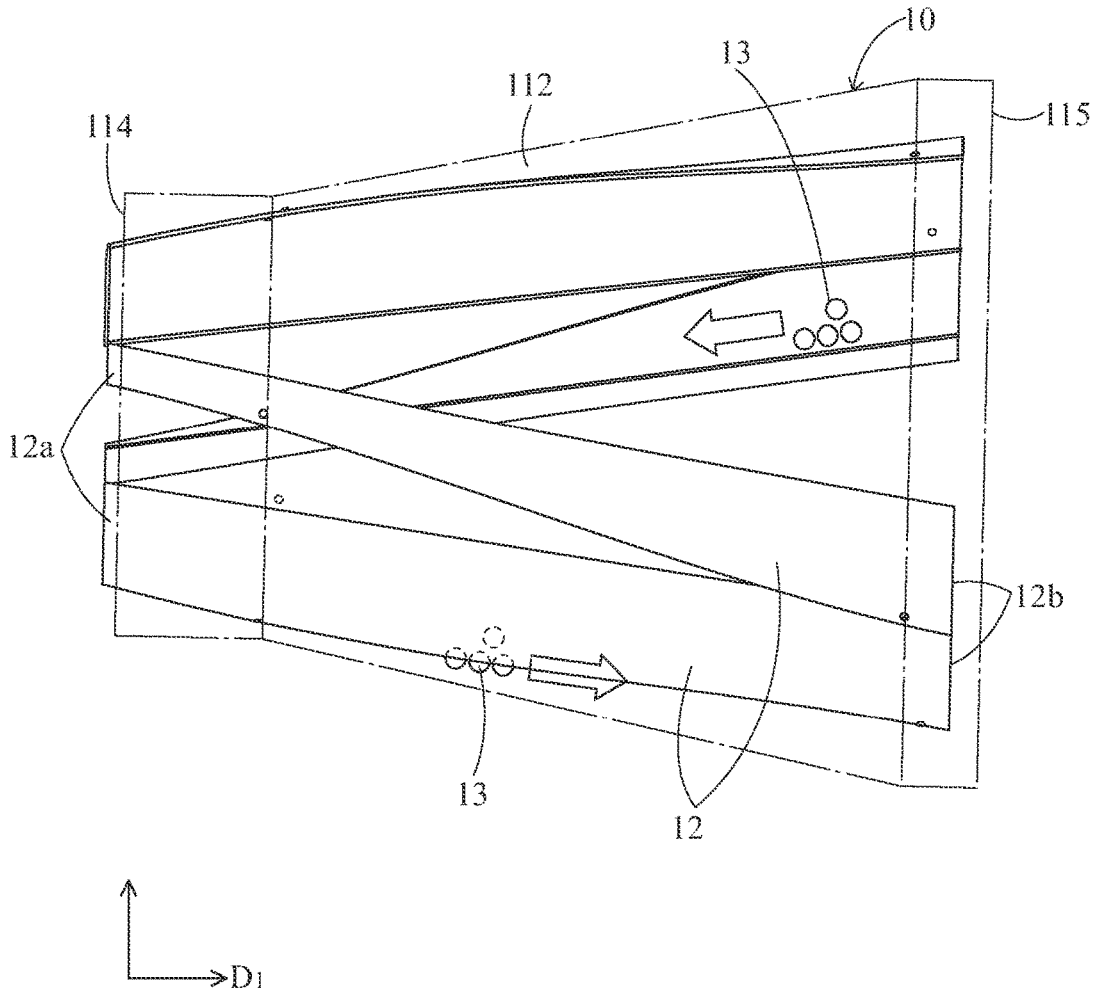
FIG. 3A is a side view of the stirring container according to the first embodiment of the present invention (where the barrel is drawn in imaginary lines)

FIG. 1 through FIG. 3A show a rear view, a perspective view and a side view of a stirring container according to the first embodiment of the present invention respectively. In the first embodiment, the present invention provides a container, and particularly a stirring container 10 for stirring a material 13 (as shown in FIG. 3A). The material 13 may be a solid material, and may be a material consisting of various constituents (e.g., five cereals, peanuts and red beans, and different kinds of coffee beans) or of a single constituent in different states (e.g., a single kind of coffee bean).

The stirring container 10 may comprise a barrel 11 and a plurality of stirring paddles 12. The barrel 11 may be formed as a hollow barrel-shaped housing for accommodating the material 13 so that the material 13 can be stirred when the barrel 11 and the stirring paddles 12 rotate together.

The barrel 11 may be defined with an inner surface 111, an outer surface 112, a center axis 113, a first opening 114 and a second opening 115. The center axis 113 extends through the barrel 11, while the first opening 114 and the second opening 115 are located at two ends of the center axis 113 respectively. Furthermore, the barrel 11 may be a truncated conical barrel or a cylindrical barrel. The first opening 114 is equal to or smaller than the second opening 115. In this embodiment, the barrel 11 is roughly a truncated conical barrel and the first opening 114 is smaller than the second opening 115.

The aforesaid truncated conical barrel is formed by cutting through a cone along two separated planes, and the part of the cone between the two separated planes is just the truncated conical barrel. In other words, the side surface, the top surface and the bottom surface of the truncated conical barrel are the outer surface 112, the first opening 114 and the second opening 115 of the aforesaid barrel 11 respectively. The outer surface 112 may be a curved surface formed by revolving a line segment, which is not parallel to the center axis 113, around the center axis 113 for one turn. The first opening 114 is formed by revolving one end of the line segment, which is closer to the center axis 113, around the center axis 113 for one turn. The second opening 115 is formed by revolving the other end of the line segment, which is farther from the center axis 113, around the center axis 113 for one turn. The line segment may not be limited to a straight line segment but may also be a curved line segment.

The stirring container 10 is further defined with a first direction D1 and a rotation direction D2. The first direction D1 is a direction from the first opening 114 to the second opening 115 which is parallel to the center axis 113. The rotation direction D2 is a direction in which the barrel 11 rotates around the center axis 113 when the stirring container 10 is operating and may be in a clockwise or counterclockwise direction.

The plurality of stirring paddles 12 is fixed on the inner surface 111 of the barrel 11 by, for example, welding, riveting, or with screws or an adhesive. The stirring paddles 12 extend in an extending direction which runs approximately along the first direction D1 but is skewed towards the rotation direction D2, so each of the stirring paddles 12 has an extending direction skewed to the center axis 113. The so-called skewing means that the extending direction of each of the stirring paddles 12 is neither parallel to the center axis 113 nor crosses the center axis 113.

Furthermore, each of the stirring paddles 12 has a first side surface 12*a* closer to the first opening 114 and a second side surface 12*b* closer to the second opening 115. The first side surface 12*a* may also optionally protrude out of the first opening.

The accommodating space of the barrel 11 may be defined with a plurality of spaces of an equal number corresponding to the number of the stirring paddles 12 (i.e., the number of the stirring paddles 12 is four in this embodiment, so the number of the spaces is also four) with each of the spaces having an equal volume. The first side surface 12*a* of each of the stirring paddles 12 is preferred to be accommodated in one of the spaces respectively. The second side surface 12*b* of each of the stirring paddles 12 is accommodated in another one of the spaces respectively. When the stirring paddles 12 extend from the first side surface 12*a* to the second side surface 12*b* in the rotation direction D2 of the barrel 11, a skewed form can be formed.

The four spaces are further described as follows: two imaginary planes 11*x* and 11*y* orthogonal to each other (the number of the planes corresponds to a half of the number of the stirring paddles 12) may be defined inside the barrel 11, and an intersection of the two planes 11*x* and 11*y* coincides with the center axis 113. The two planes 11*x* and 11*y* can divide the accommodating space inside the barrel 11 into four portions as the aforementioned four spaces respectively.

Next, the construction of each of the stirring paddles 12 is described. Each of the stirring paddles 12 may be constructed to have a shape capable of supporting the material 13. In this embodiment, each of the stirring paddles 12 may be a curved plate; that is, the first side surface 12*a* and the second side surface 12*b* of each of the stirring paddles 12 and the section between the first side surface 12*a* and the second surface 12*b* are all bowl-shaped or crescent-shaped. Preferably, the curvature radius of the first side surface 12*a* may be equal to or smaller than a curvature radius of the second surface 12*b*; and in this embodiment, the curvature radius of the first side surface 12*a* may be smaller than that of the second side surface 12*b* so that the stirring paddles 12 can accommodate more material 13 at the second opening 115.

Then, the stirring method of the stirring container 10 is described. After the material 13 is put into the barrel 11, the barrel 11 begins to rotate around the center axis 113. Because the barrel 11 is a truncated conical barrel, the lowest point of the second opening 115 is lower than the lowest point of the first opening 114 when the rotation axis (the center axis 113) of the barrel 11 is parallel to the ground. Therefore, when the barrel 11 is rotating, the material 13 moves from the first opening 114 towards the second opening 115 due to gravity.

Then, the material 13 moves onto the stirring paddles 12 and moves upwards as the stirring paddles 12 rotate. Since the stirring paddles 12 are skewed to the center axis 113, the material 13 on the stirring paddles 12 will, when the stirring paddles 12 rotate to a particular position (i.e., when the position of the second side surface 12*b* is higher than that of the first side surface 12*a*), move from a place near the second side surface 12*b* to a place near the first side surface 12*a* due to gravity and thus, returns to the first opening 114.

Accordingly, as the barrel 11 rotates, the material 13 is repeatedly moved down to the second opening 115 from the first opening 114 and then raised up back to the first opening 114 by the stirring paddles 12 so that the material 13 can be adequately stirred by continuously moving in a horizontal and vertical direction in the barrel 11.

Figure 3B:
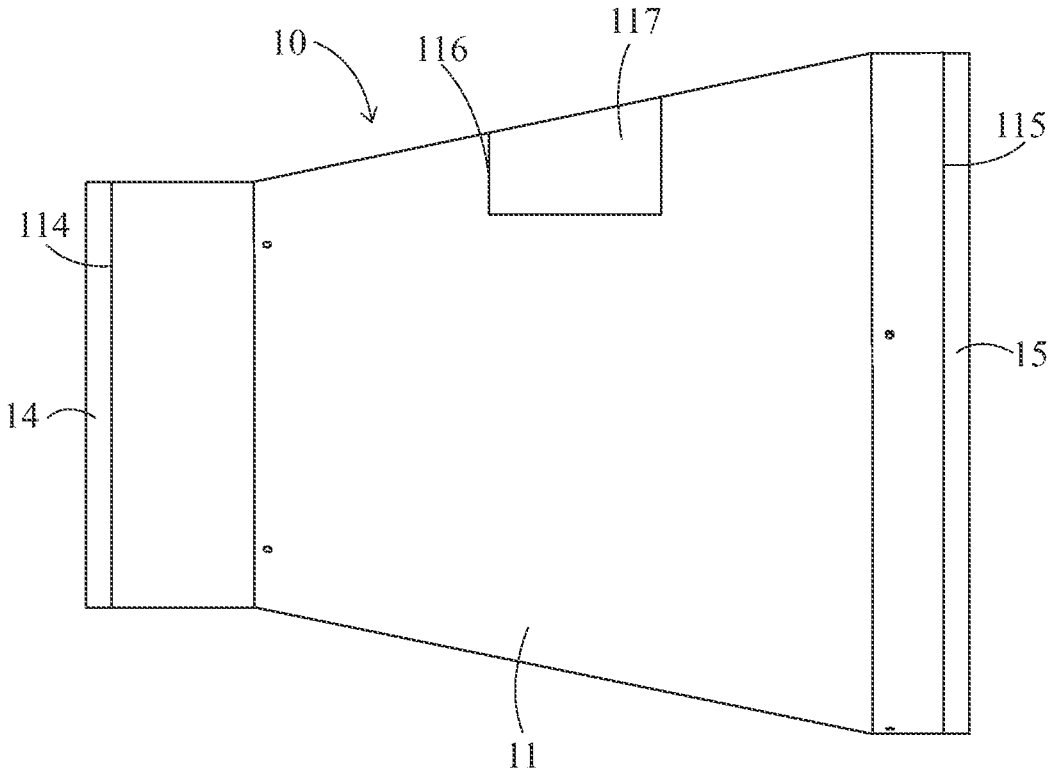
FIG. 3B is a side view of a stirring container according to the second embodiment of the present invention.

Next, FIG. 3B shows a side view of the stirring container according to the second embodiment of the present invention. The second embodiment has technical features similar to the first embodiment, but differs from the first embodiment in that: the stirring container 10 may further have a first lid 14 disposed at the first opening 114 to selectively cover the first opening 114 and a second lid 15 disposed at the second opening 115 to selectively cover the second opening 115. By disposing the first lid 14 or the second lid 15, the material 13 is less likely to be dropped from the first opening 114 or from the second opening 115. The first lid 14 or the second lid 15 may be formed integrally with the barrel 11, or may be separately produced and then fixed onto the barrel 11.

Another difference of the second embodiment from the first embodiment is that: the barrel 11 of the stirring container 10 may further have a lateral opening 116. The lateral opening 116 is located on the outer surface 112 and communicates with the inside of the barrel 11. The lateral opening 116 may be located between the first opening 114 and the second opening 115. The material 13 can be put into or taken out of the stirring container 10 through the lateral opening 116. To prevent the material from dropping 13 from the lateral opening 116 when being stirred, the barrel 11 of the stirring container 10 may further have a lateral lid 117 adapted to selectively cover the side opening 116.

The third embodiment may be devised for the stirring container of the present invention, which has technical features similar to the first embodiment or the second embodiment but differs therefrom in that: the barrel 11 is a cylindrical barrel, that is, the size of the first opening 114 of the barrel 11 is equal to that of the second opening 115 of the barrel 11.

To make the material 13 in the stirring container 10 move in the first direction D1 due to gravity when the stirring container 10 is operating, the barrel 11 is placed in such a way that the center axis 113 is not parallel to the horizontal plane and the first opening 114 is higher than the second opening 115. Accordingly, as the barrel 11 rotates, the material 13 on the inner surface 111 concentrates towards the second opening 115 due to gravity and the material 13 on the stirring paddles 12 moves towards the first opening 114 due to gravity.

There is a fourth embodiment of the stirring container of the present invention, which has technical features similar to the first embodiment, the second embodiment or the third embodiment but differs therefrom in that: each of the stirring paddles 12 may be a flat plate, that is, the first side surface 12*a*, the second side surface 12*b* and the portion between the first side surface 12*a* and the second side surface 12*b* of each of the stirring paddles 12 all have a rectangular cross section. The width of first side surface 12*a* may be equal to or smaller than a width of the second side surface 12*b*.

Accordingly, in any of the embodiments, the stirring container 10 can not only move the material 13 up and down in a vertical direction, but also cause reciprocating horizontal movement to the material 13 between the first opening 114 and the second opening 115, thus increasing the opportunity of flipping over the material 13 to achieve a better mixing effect. In addition to mixing the material 13, the stirring container 10 may also carry out other processing on the material 13 (e.g., the heating treatment as described below) by using other apparatuses in combination; in other words, the function of the stirring container 10 is not limited to mixing materials.

Figure 4:
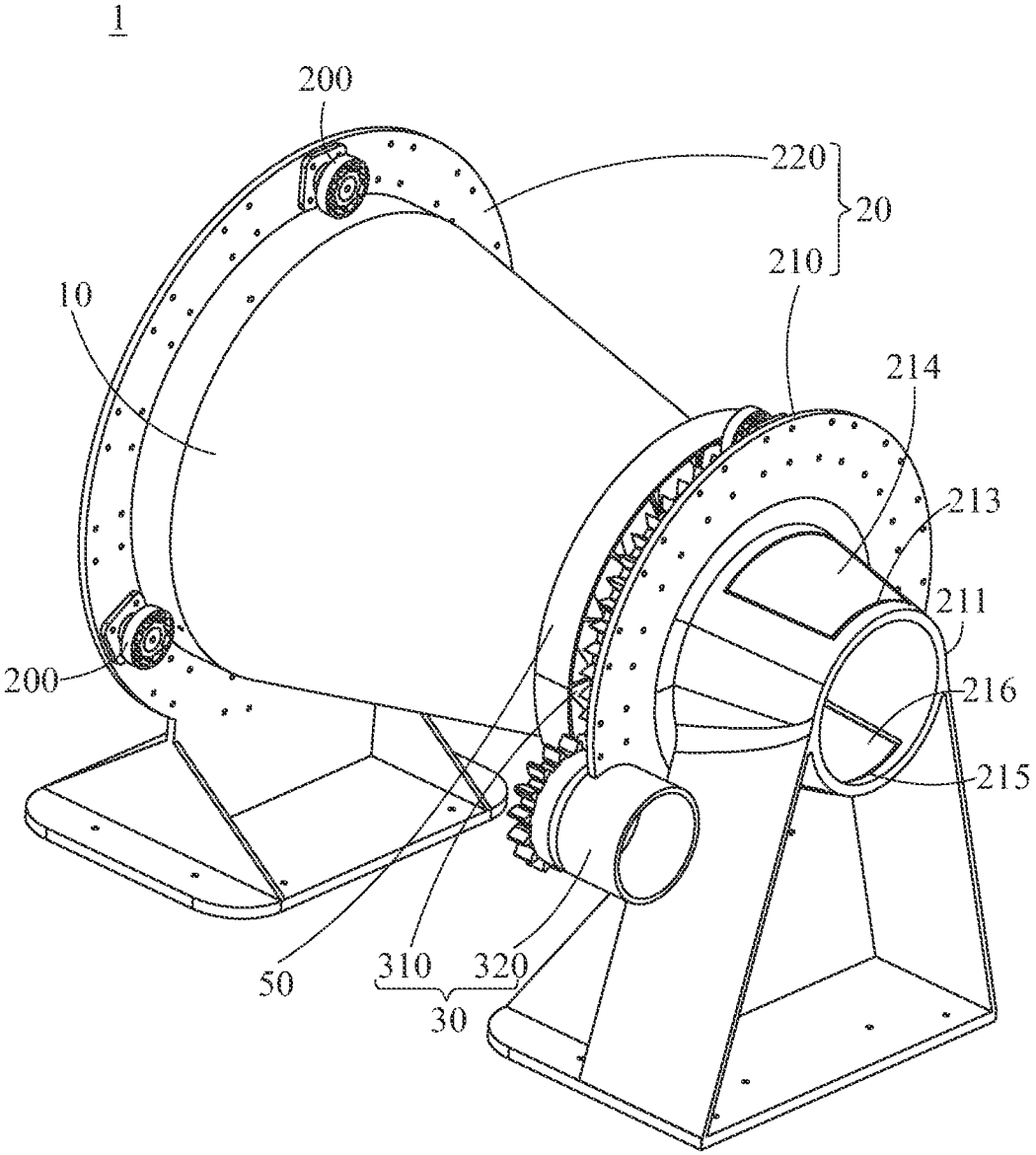
FIG. 4 is a perspective assembly view of a stirring apparatus according to the fifth embodiment of the present invention.
Figure 5:
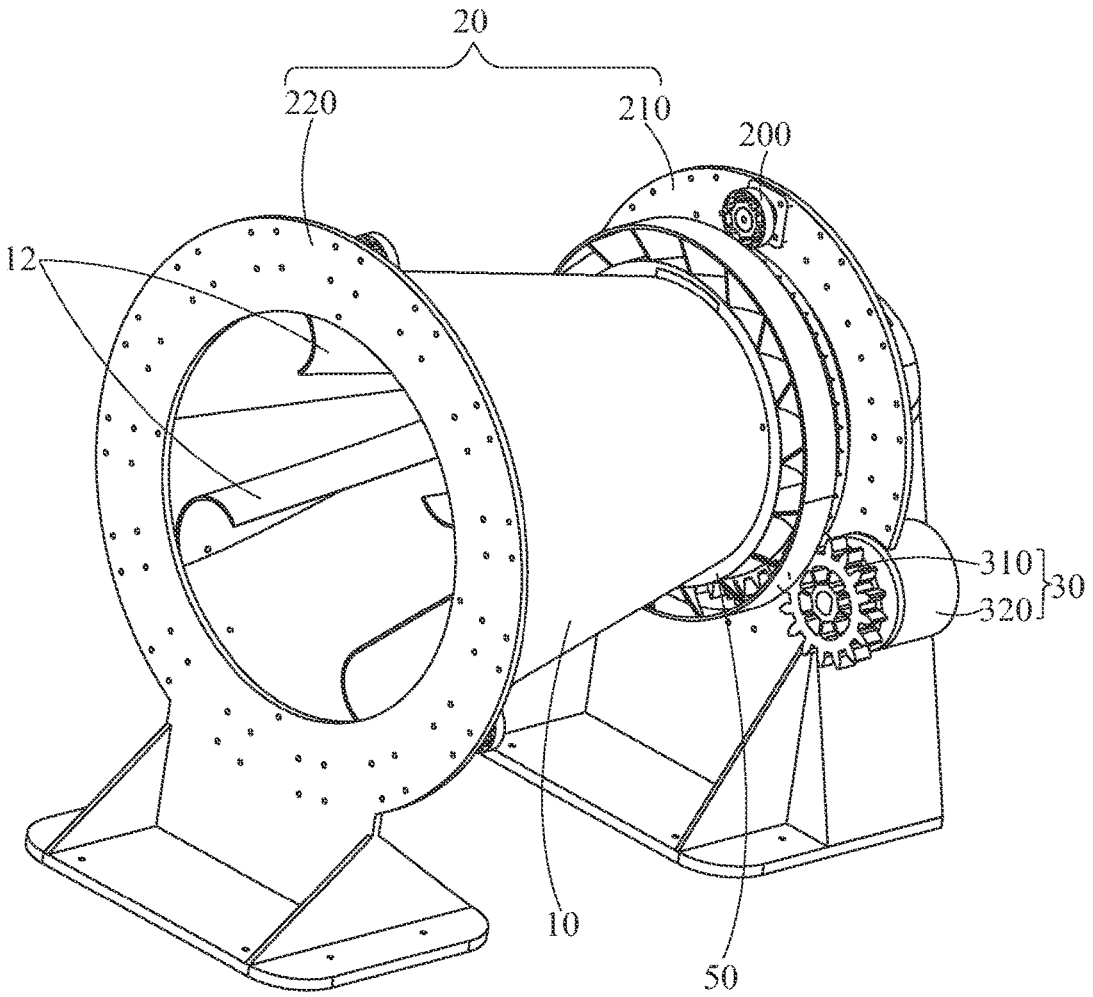
FIG. 5 is a perspective assembly view of the stirring apparatus according to the fifth embodiment of the present invention at another viewing angle.
Figure 6:
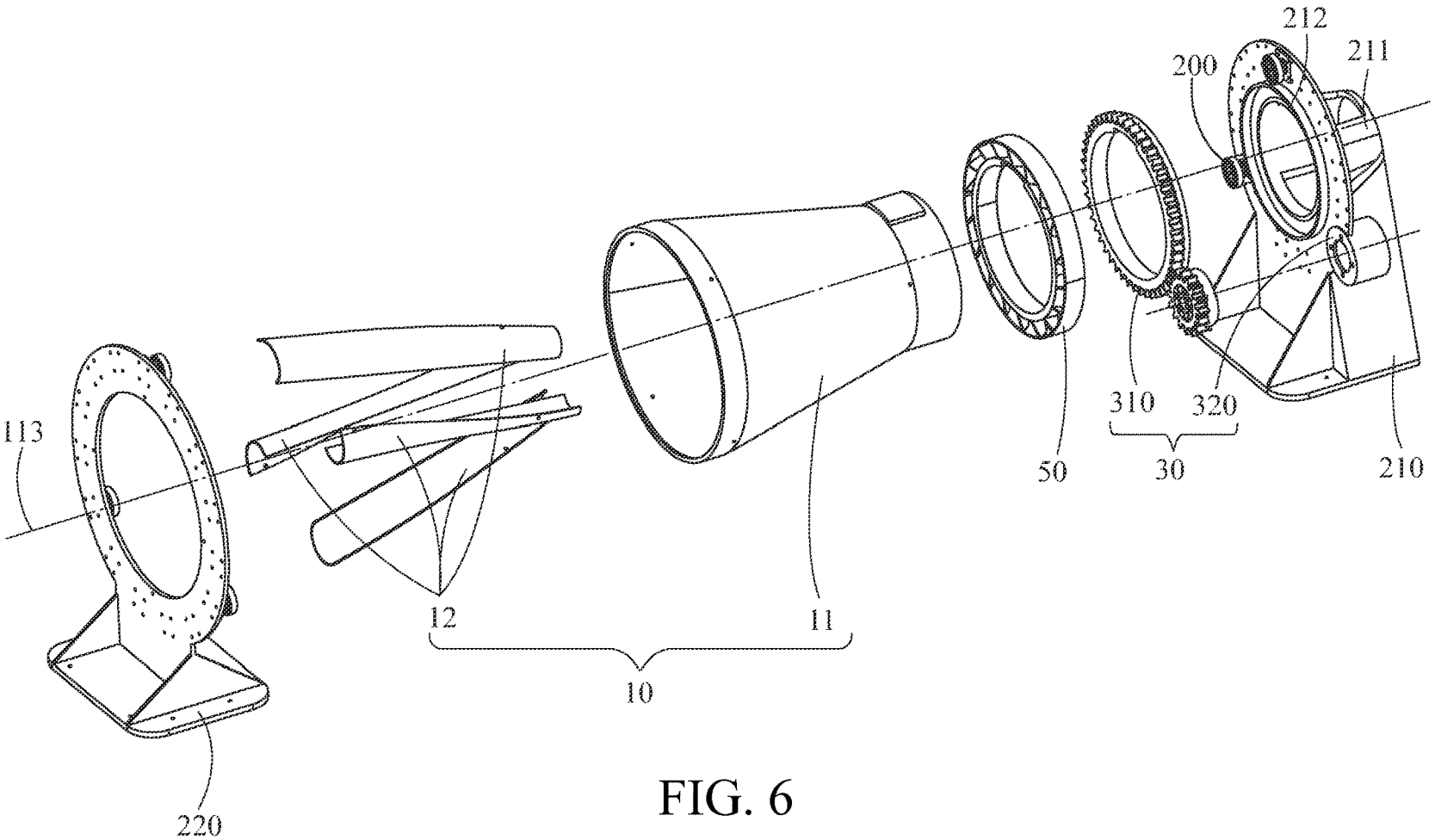
FIG. 6 is an exploded perspective view of the stirring apparatus according to the fifth embodiment of the present invention.

A stirring apparatus is further provided in the present invention. FIG. 4 to FIG. 6 show a perspective assembly view, another perspective assembly view and an exploded perspective view of the stirring apparatus according to the fifth embodiment of the present invention.

Figure 7:
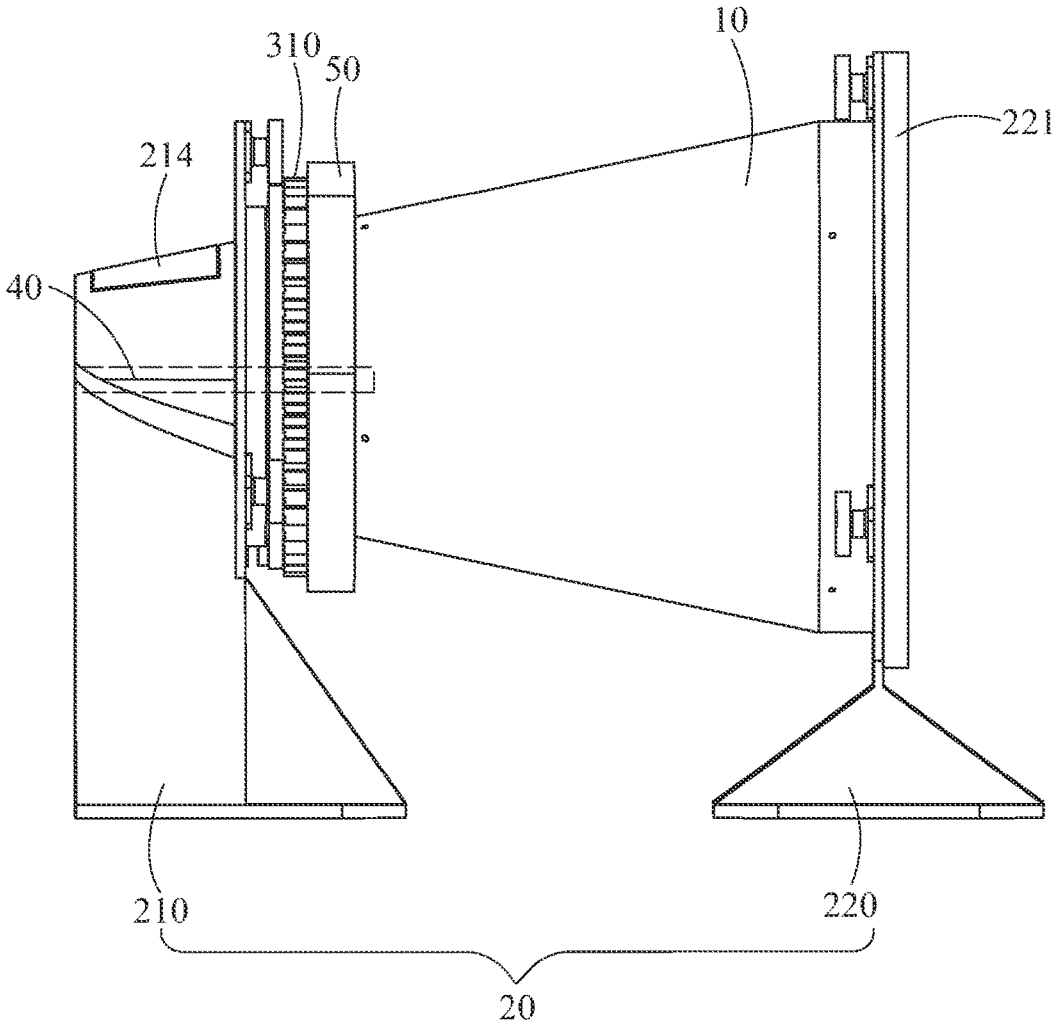
FIG. 7 is a side view of the stirring apparatus according to the fifth embodiment of the present invention.

The stirring apparatus 1 may comprises a stirring container 10, a supporting structure 20 and a rotation module 30. The stirring container 10 may be the stirring container of the above embodiments; and the supporting structure 20 is connected to the outer surface 112 of the barrel 11 of the stirring container 10 to make the stirring container 10 rotate around the center axis 113 and can also cover the second opening 115 (as shown in FIG. 7).

The supporting structure 20 supports the barrel 11 preferably at the first opening 114 and the second opening 115 of the barrel 11, so the supporting structure 20 comprises a first supporting part 210 located at the first opening 114 and a second supporting part 220 located at the second opening 115. The first supporting part 210 and the second supporting part 220 can determine the height of the first opening 114 and the second opening 115 to make the center axis 113 parallel to or not parallel to the horizontal plane. To make the barrel 11 rotatable, the first supporting part 210 and the second supporting part 220 may support the barrel 11 via a plurality of rollers 200 or via a bearing (not shown).

The rotation module 30 is joined to the outer surface 112 of the barrel 11 to rotate the stirring container 10. The rotation module 30 may have an actuator 320 and a gear set 310, and the gear set 310 may link to the actuator 320 and the outer surface 112 of the barrel 11. Specifically, the gear set 310 may have a ring spur gear fixed on the outer surface 112 and a spur gear fixed on the actuator 320. The actuator 320 may generate a torque which is transmitted to the barrel 11 by means of the gear set 310 that is linked to the actuator 320 to rotate the barrel 11.

The first supporting part 210 may comprise a delivering barrel 211 through which the material 13 (as shown in FIG. 3) may be put into or taken out of the barrel 11. The delivering barrel 211 has a delivering opening 212. The delivering opening 212 connects to the first opening 114 so that the inner space of the delivering barrel 211 communicates with the inner space of the barrel 11. The lowest point of the delivering opening 212 may be higher than the lowest point of the first opening 114 and the inner surface of the delivering barrel 211 has a skewed surface, so when the material 13 is put into the delivering barrel 211 by a user, the material 13 will slide into the barrel 11 due to gravity. The stirring paddles 12 of the stirring container 10 can extend into the delivering barrel 211, that is, the first side surface 12*a* of each of the stirring paddles 12 can be located in the delivering barrel 211.

In order to make it convenient for the user to put the material 13 into the barrel 11, the delivering barrel 211 further has an entrance opening 213. The opening direction of the entrance opening 213 is parallel to or crosses an opening direction of the delivering opening 212. If the opening direction of the entrance opening 213 is parallel to the opening direction of the delivering opening 212 (i.e., the entrance opening 213 opens backwards), it will be easy for the user to put the material 13 into or to take the material 13 out of the barrel 11 through the entrance opening 213. If the opening direction of the entrance opening 213 crosses the opening direction of the delivering opening 212 (e.g., the entrance opening 213 opens upwards), the dropping out of the material 13 from the entrance opening 213 can be avoided during operation.

Furthermore, the delivering barrel 211 may further have an entrance lid 214 disposed at the entrance opening 213 to selectively cover the entrance opening 213. When the entrance opening 213 is covered by the entrance lid 214, dropping out of the material 13 from the entrance opening 213 or entry of other objects (e.g., dusts or mosquitoes) into the barrel 11 through the entrance opening 213 can be prevented.

To make it convenient to take the material 13 which has been stirred out of the barrel 11, the delivering barrel 211 may further have an exit opening 215 and an exit lid 216. The exit opening 215 has an opening direction crossing the opening direction of the delivering opening 212 and, preferably, opens downwards. The exit lid 216 is disposed at the exit opening 215 to selectively cover the exit opening 215.

Next, the way of operating the stirring apparatus 1 in combination with the delivering barrel 211 will be described. With reference to FIG. 3A and FIG. 4, firstly the material 13 is put into the delivering barrel 211 and then moves to the second opening 115 of the barrel 11 of the stirring container 10 due to gravity; next, the barrel 11 begins to rotate as being driven by the rotation module 30 so that the material 13 is raised by the stirring paddles 12 to move back into the delivering barrel 211 (because the first side surface 12*a* of each of the stirring paddles 12 is located in the delivering barrel 211). The material 13 repeatedly experiences these two steps until a desired stirring state or processing state has been achieved.

After the desired stirring or processing state of the material 13 has been achieved, the user may open the exit lid 216 to uncover the exit opening 215. Because the exit opening 215 opens downwards, the material 13 drops back into the delivering barrel 211 to drop out of the exit opening 215 automatically. Accordingly, the user can easily collect the material 13 simply by putting another container under the exit opening 215.

FIG. 7 illustrates side view of the stirring apparatus according to the fourth embodiment of the present invention. The second supporting part 220 may have a transparent lid 221 adapted to selectively cover the second opening 115. Therefore, the transparent lid 221 functions like the second lid 15 of the barrel 11 and either of them can be selected for use. When the stirring apparatus 1 is in operation, the user can, in addition to controlling the stirring process by using a program (not shown) (e.g., predetermining parameters such as the rotation speed and the stirring time), adjust parameters such as the rotation speed or the stirring time according to the stirring degree of the material 13 by observing through the transparent lid 221, thereby controlling the stirring process on his own. The transparent lid 221 can be a lid with just a portion transparent or hollow for lights passing into the stirring container 10; the transparent lid 221 also can have all portions transparent as a glass plate.

Referring next to FIG. 7, the stirring apparatus 1 may further include a heater 40 fixed to the supporting structure 20, and the heater 40 extends into the barrel 11 to heat the barrel 11 or the material 13 in the barrel 11. Thus, the material 13 can be heated while being stirred so that the material 13 can be uniformly heated. For example, the coffee beans that are stirred and heated simultaneously in this way can be uniformly heated so that uniformly baked coffee beans can be obtained. The heater 40 may be a tubular or a flat-plate-shaped heater (e.g., a ceramic heater or a quartz heater) that can transfer heat through irradiation.

Next, with reference to FIGS. 5 to 7, when the material 13 is heated by the heater 40, the high-temperature outer surface 112 of the barrel 11 might burn the user when he or she touches it accidentally. To make an improvement on this problem, the stirring apparatus 1 may further comprise a plurality of fan blades to reduce the temperature of the outer surface 112. Specifically, the fan blades 50 are fixed on the outer surface 112 of the barrel 11, and when the stirring container 10 is rotating, the fan blades 50 will also rotate along with it so that the temperature of the outer surface 112 is reduced through the air convection from the outer surface 112.

Figure 8:
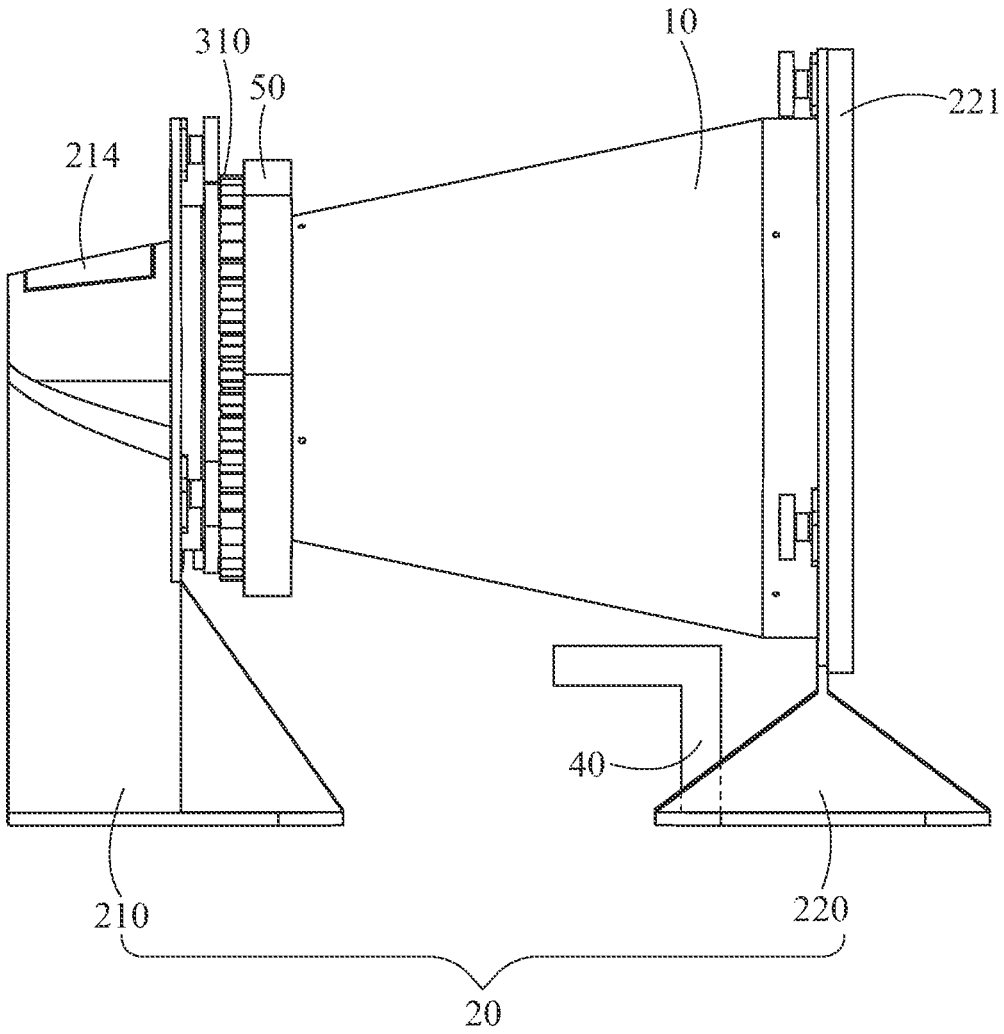
FIG. 8 is a side view of a stirring apparatus according to the sixth embodiment of the present invention.

FIG. 8 illustrates the side view of the stirring apparatus according to the sixth embodiment of the present invention. The sixth embodiment has technical features similar to the fifth embodiment but differs from the fifth embodiment in that: the heater 40 is disposed outside the barrel 11 to heat the outer surface 112 of the barrel 11. Preferably, the heater 40 may be a flame generator disposed under the barrel 11. The heat generated by the heater 40 may be transferred to the material 13 via the outer surface 112 and the inner surface 111 of the barrel 11.

According to the above descriptions, the stirring apparatus of the present invention can make the material flip over vertically and horizontally to achieve the objective of mixing or stirring the material adequately. Furthermore, the stirring apparatus of the present invention may further heat the material (or carry out other processing) while the material is flipped over to uniformly heat the material to maintain the heating quality.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A stirring container for accommodating and stirring a solid material, comprising:

a barrel defined with an inner surface, an outer surface, a center axis, a first opening and a second opening, and the first opening and the second opening being located at two ends of the center axis respectively, wherein the barrel is a truncated conical barrel with the first opening smaller than the second opening; and a plurality of stirring paddles fixed on the inner surface of the barrel, each of the stirring paddles extending from the first opening to the second opening and having an extending direction skewed to the center axis, wherein each of the stirring paddles has a first side surface closer to the first opening, a second side surface closer to the second opening and sections between the first side surface and the second surface, wherein the sections are bowl-shaped or crescent-shaped;

wherein each of the stirring paddles is skewed towards a rotation direction of the barrel, a lowest point of the second opening is lower than a lowest point of the first opening, and one of the stirring paddles has the first side surface thereof higher than the second side surface thereof in relative to the lowest point of the second opening, and another one of the stirring paddles has the first side surface thereof lower than the second side surface thereof in relative to the lowest point of the second opening, such that the solid material reciprocates between the first opening and the second opening when the barrel rotates in the rotation direction.

2. The stirring container according to claim 1, wherein a curvature radius of the first side surface is equal to or smaller than a curvature radius of the second side surface.

3. The stirring container according to claim 1, further comprising a first lid disposed at the first opening to cover the first opening.

4. The stirring container according to claim 1, further comprising a second lid disposed at the second opening to cover the second opening.

5. The stirring container according to claim 1, wherein the barrel further comprises a lateral opening located on the outer surface and a lateral lid to selectively cover the lateral opening.

6. A stirring apparatus, comprising:

the stirring container according to claim 1;

a supporting structure connected to the outer surface of the barrel of the stirring container to make the stirring container rotatable, and the supporting structure covering the second opening; and a rotation module joined to the outer surface of the barrel to rotate the stirring container.

7. The stirring apparatus according to claim 6, wherein the supporting structure comprises a first supporting part located at the first opening, and a second supporting part located at the second opening.

8. The stirring apparatus according to claim 7, wherein the first supporting part comprises a delivering barrel having a delivering opening, and the delivering opening connects to the first opening so that an inner space of the delivering barrel communicates with an inner space of the barrel.

9. The stirring apparatus according to claim 8, wherein the delivering barrel further has an entrance opening, and an opening direction of the entrance opening is parallel to or crosses an opening direction of the delivering opening.

10. The stirring apparatus according to claim 9, wherein the delivering barrel further has an entrance lid disposed at the entrance opening to selectively cover the entrance opening.

11. The stirring apparatus according to claim 9, wherein the delivering barrel further has an exit opening and an exit lid, the exit opening has an opening direction crossing the opening direction of the delivering opening, and the exit lid is disposed at the exit opening to selectively cover the exit opening.

12. The stirring apparatus according to claim 9, wherein the second supporting part has a transparent lid coving the second opening.

13. The stirring apparatus according to claim 6, further comprising a heater fixed to the supporting structure and extending into the barrel.

14. The stirring apparatus according to claim 6, further comprising a heater disposed outside the barrel to heat the outer surface of the barrel.

15. The stirring apparatus according to claim 6, further comprising a plurality of fan blades fixed on the outer surface of the barrel.

16. The stirring apparatus according to claim 6, wherein the rotation module has an actuator and a gear set linking to the actuator and the outer surface of the barrel.

* * * * *